United States Patent [19]

Bertagnoli

[11] 4,347,719

[45] Sep. 7, 1982

[54] CIRCULAR KNITTING MACHINES FOR KNITTING ARTICLES OF TERRY FABRIC

[75] Inventor: Leopoldo Bertagnoli, Turin, Italy

[73] Assignee: Officine Savio S.p.A., Italy

[21] Appl. No.: 127,877

[22] Filed: Mar. 6, 1980

[30] Foreign Application Priority Data

Mar. 13, 1979 [IT] Italy ..... 9365 A/79

[51] Int. Cl.[3] ..... D04B 35/00; D04B 9/12

[52] U.S. Cl. ..... 66/91; 66/14

[58] Field of Search ..... 66/14, 63 (U.S. only), 66/91, 92, 93, 104

[56] References Cited

U.S. PATENT DOCUMENTS

| | | | |
|---|---|---|---|
| 1,986,317 | 1/1935 | Bentley et al. | 66/14 |
| 2,276,705 | 3/1942 | Smith, Jr. | 66/93 |
| 2,719,416 | 10/1955 | Saunders | 66/14 |

FOREIGN PATENT DOCUMENTS

| | | | |
|---|---|---|---|
| 718278 | 10/1966 | Italy | 66/104 |
| 934443 | 8/1963 | United Kingdom | 66/14 |

*Primary Examiner*—Wm. Carter Reynolds

*Attorney, Agent, or Firm*—McGlew and Tuttle

[57] ABSTRACT

A double cylinder circular knitting machine for forming articles of terry fabric, comprises, in one of the cylinders (3), a ring of arcuate terry sinkers (24) each controlled by a butt (24A) so that it carries out a reciprocating angular sliding movement in an arcuate seat (22) in the end of the cylinder (3), and a loop withdrawal ring (26) for retaining the loop during the withdrawal of the end of the sinker (24) from the loop. The working end of the sinker (24) is rotated before its forward movement, so as to move it away from the loop withdrawal ring (26), and enables it to pass over the loop just formed on the previous course, the sinker (24) then being rotated in the reverse direction for forming the next loop. This arrangement permits loops to be formed in each course of the fabric.

3 Claims, 14 Drawing Figures

CIRCULAR KNITTING MACHINES FOR KNITTING ARTICLES OF TERRY FABRIC

FIELD AND BACKGROUND OF THE INVENTION

This invention relates to a knitting and stocking machine, in particular a double cylinder circular knitting machine, for forming articles of terry fabric.

DESCRIPTION OF THE PRIOR ART

Machines of this type comprise in one of the faces, in particular in the upper cylinder, a series of arcuate sinkers for forming the terry or loop, which are controlled by way of a butt to carry out a reciprocating angular sliding movement in arcuate seats in the end of the face, and a loop withdrawal rim or ring arranged to retain the terry or loop during the withdrawal of the working end of the sinker from the loop in the centripetal direction.

The object of the invention is to form a terry fabric with its loops or terrys on all the courses, it being possible at the present time to provide the loops only on courses which are spaced apart, or at most alternate, because of the risk of a terry or loop becoming reinserted by the arcuate sinker during its forward movement following its loop withdrawal movement.

SUMMARY OF THE INVENTION

The invention solves the problem of preventing the sinker from becoming reinserted into a loop from which it has just withdrawn, thereby allowing the formation of terrys or loops on all courses.

According to the invention, means are provided for rotating the sinker in its own plane (upwards) before its forward movement, so as to move the working end of the sinker away from the loop withdrawal ring, in order to enable it to pass over the terrys or loops of the previous course, and then to rotate it in the reverse direction for forming the next loop.

One embodiment of a double cylinder circular knitting machine comprises the following features. The terry sinkers are partly cut-away over about one half of their concave contour in order to allow rotation. Cam means are provided to act on the sinker in that portion, or in each of those portions of a circular path, defined by the arcuate seats formed in the cylinder, during which the sinker working end moves forward after having moved backward for withdrawing from the loop. The cam means are provided to act on the sinker in order to rotate it in its seat, so as to move the working end away from the loop withdrawal ring, immediately before the working end moves forward. A shaped recess is provided in the profile of a cylinder portion adjacent the arcuate seat known as the inner skirt of the channel cam, for controlling the sinker butt. The shaped recess causes both said rotation and the subsequent reverse rotation of the sinker during the completion of the forward movement of the sinker by angular sliding.

The sinker can be cut away over that part of the concave profile between the working end and an intermediate point which defines the fulcrum, approximately in a position corresponding to the control butt, and the recess in the skirt is shaped so that it acts on the convex contour of that part of the sinker most distant from its end.

The cam means can act along the convex contour of the sinker adjacent to its working end, and they are therefore located adjacent to the loop withdrawal ring.

The invention will be more apparent from the description given hereinafter with reference to the accompanying drawing which shows one non-limiting embodiment thereof.

DESCRIPTION OF THE PREFERRED EMBODIMENTS

Figure 1:
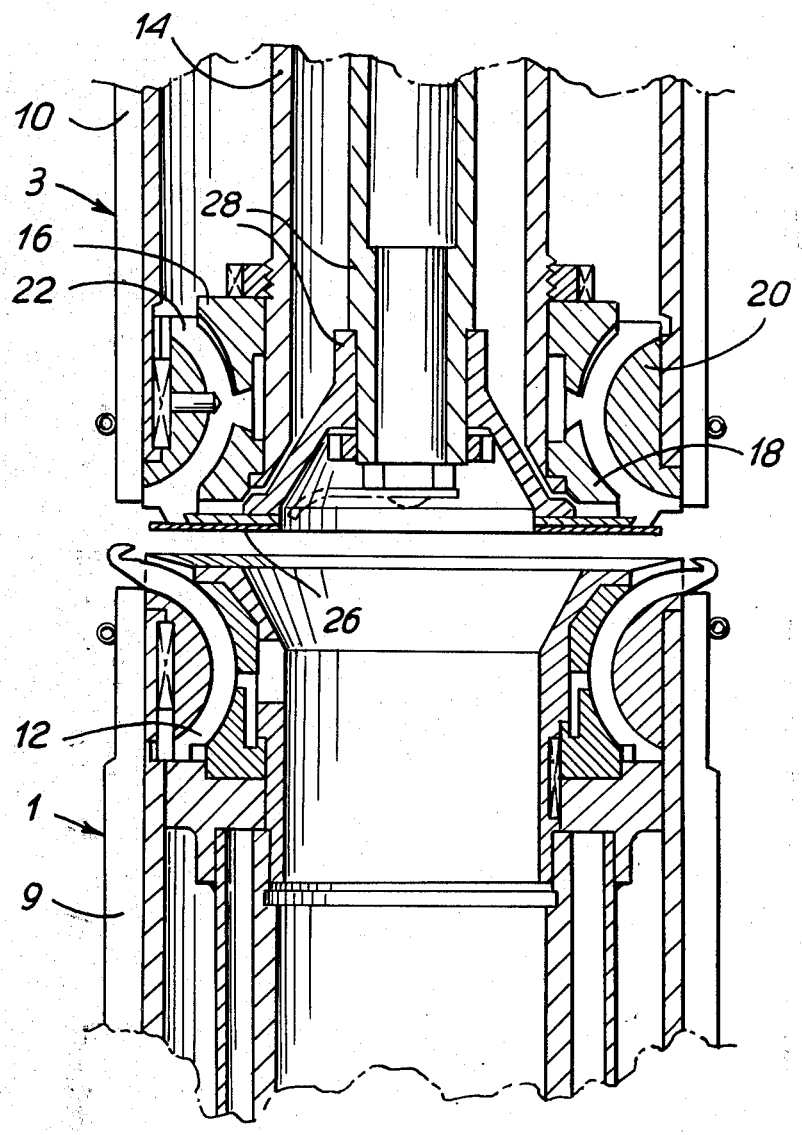
FIG. 1 is an overall section through a double cylinder of a machine equipped for articles of terry fabric.
Figure 4:
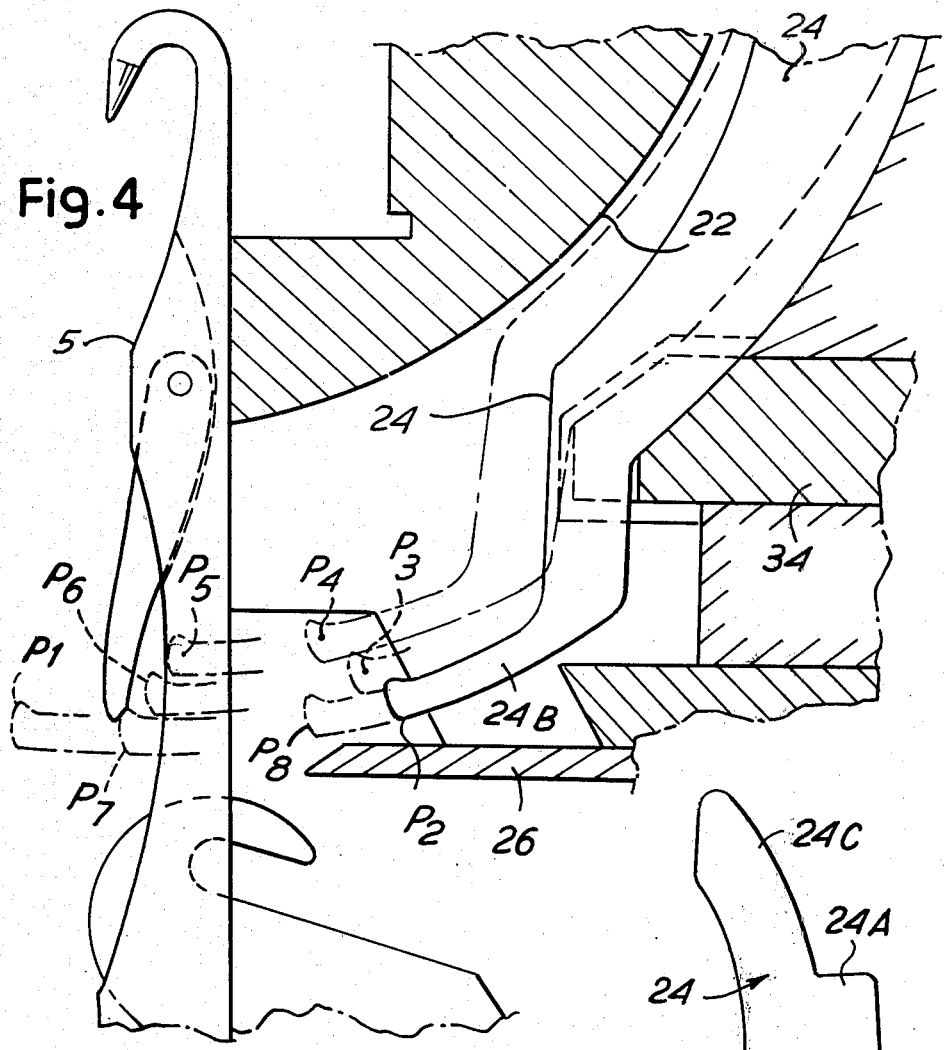
FIG. 4 shows a further enlarged detail, in which the various positions are indicated.

The accompanying drawing shows a lower needle cylinder 1 and an upper cylinder 3. The reference numeral 5 indicates conventional double hooked needles for operation by conventional selectors, sliders or jacks in slots 9 and 10 in the cylinders 1 and 3 respectively. The reference numeral 12 indicates arcuate sinkers with a terminal hook, which are located in slide seats formed at the upper end of the lower cylinder 1. These sinkers are also of conventional type.

Figure 2:
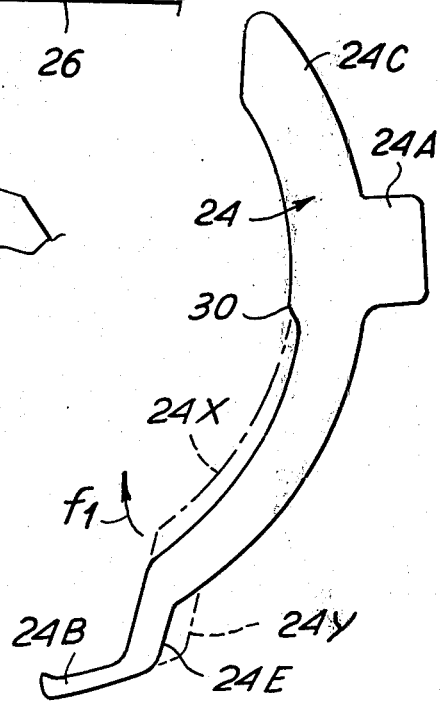
FIG. 2 shows an arcuate sinker modified according to the invention.
Figure 3A:
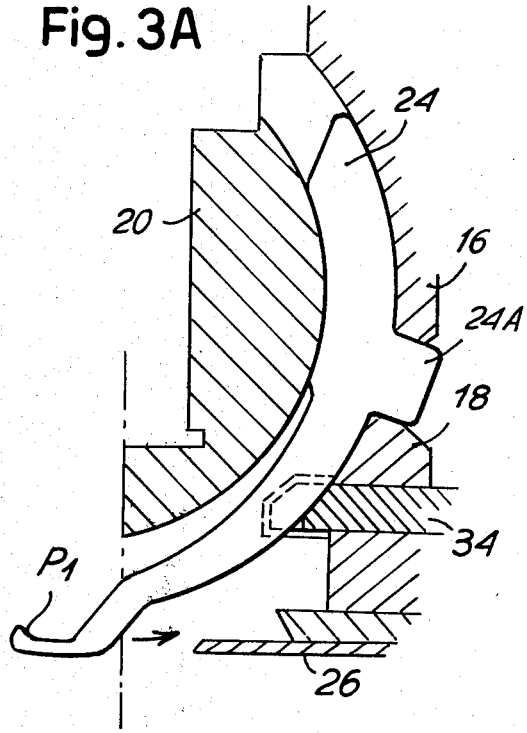
FIGS. 3A, 3B, 3C . . . 3G, 3H show an enlarged detail of FIG. 1 in successive views with the arcuate sinker in various positions.
Figure 3B:
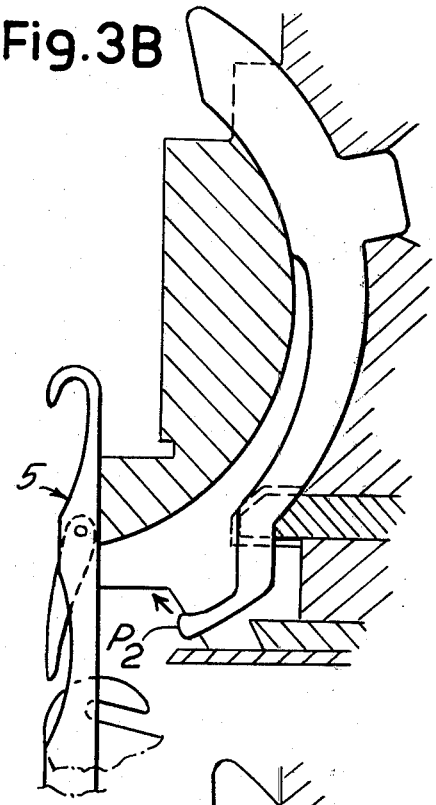
Figure 3C:
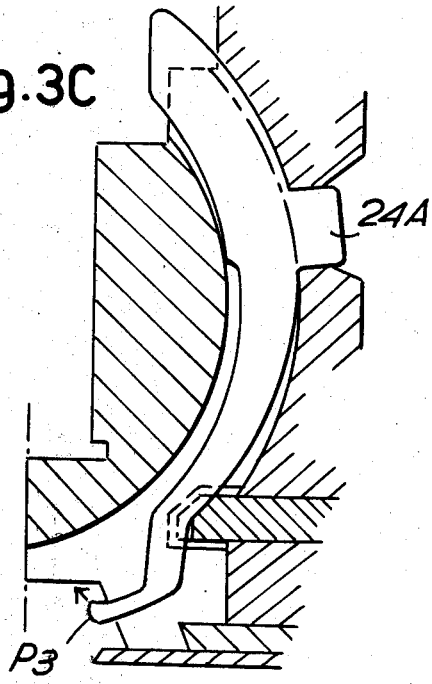
Figure 3D:
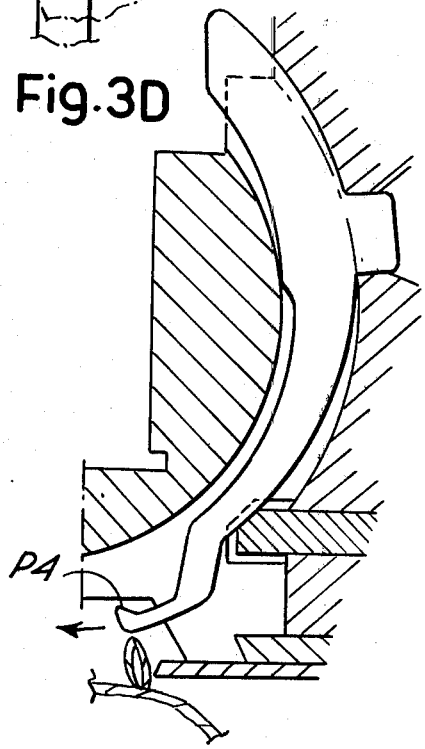
Figure 3E:
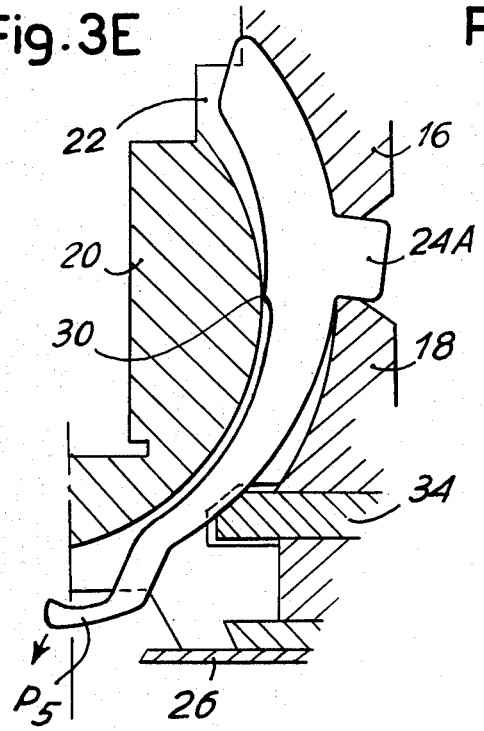
Figure 3F:
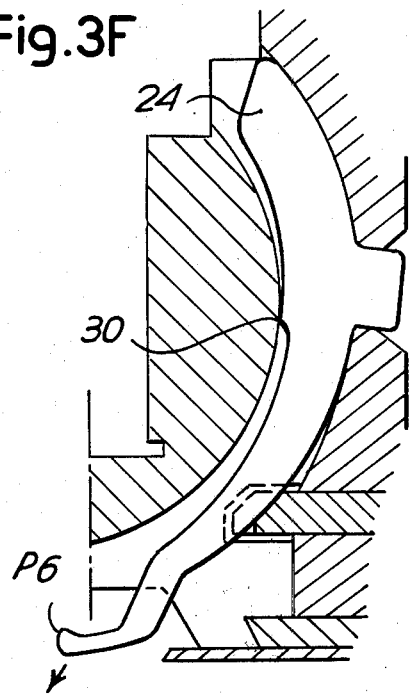
Figure 3G:
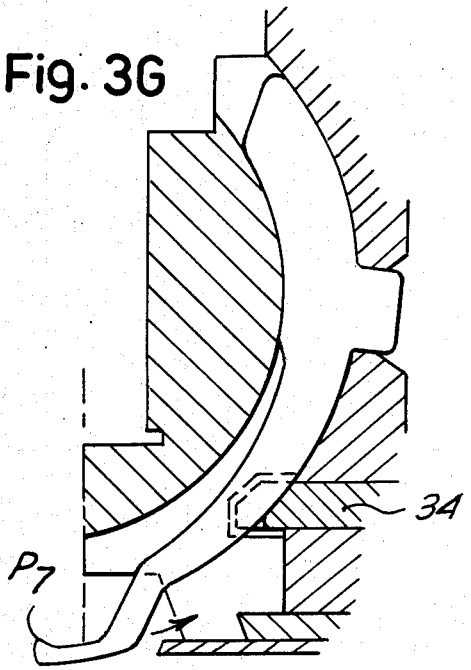
Figure 3H:
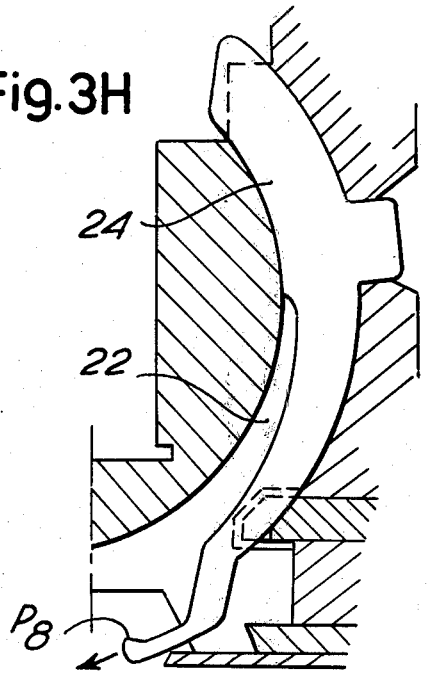

In order to make a knitted article of terry fabric, the upper cylinder 3 is normally fitted with a device comprising a support 14 carrying two annular opposing elements 16, 18 to constitute a control track for the butts of special arcuate sinkers to be described. The elements 16, 18 are combined with a third element 20 to form a face bed of slide seats 22 for said special arcuate sinkers 24. Normally these sinkers 24 have a contour as shown in FIG. 2, complete with the regions bounded by the dashed and dotted lines 24X and 24Y. The sinkers 24 comprise an intermediate butt 24A on their convex edge, and an extension 24B at their working end which terminates in a slight hook for engaging the terry or loop being formed for the terry fabric. The extension 24B grazes an annular loop withdrawal rim or ring 26, carried by a support 28 internal to the support 14, and extending perimetrally over the knitting formation region.

In conventional constructions, each sinker 24 slides in its arcuate seat 22 under the control of the butt 24A and the control contour defined by the elements 16, 18, to carry out substantially angular excursions with their center of rotation at the center of curvature of the seats 22. In this manner, over the circumferential trajectory the extension 24B moves forwards and backwards alternately between the outer position P1 and the inner position P2, almost grazing the perimeter of the rim 26 during its equal outward and return trajectories. The consequence of this is that the terry or loop formed on the extension 24B when this is in position P1 is released from the extension and is retained by the perimeter of the loop withdrawal rim 26 while the extension withdraws to position P2. Normally, after withdrawal from a terry or loop, a course of knitting without any terry or loop has to be made in order to cause the article to move through a sufficient distance for the released terry or loop to incline or move sufficiently so as not to become again inserted by the extension 24B when it again moves in the centrifugal direction from position P2 to position P1. If a terry or loop were to be formed on each course, it would not be possible to prevent frequent reinsertion of the extension 24B into the terry or loop which has just been abandoned. This necessarily sparse formation of the terrys or loops is a drawback which is obviated by the apparatus according to the invention.

As stated, according to the invention, in addition to sliding in the arcuate seat, the sinker 24 is made to rotate in its own plane so that during its centrifugal stroke in passing from position P2 to position P1, the end 24B of the sinker extension travels through an arcuate trajectory which rises and then lowers in passing through intermediate positions P3, P4, P5, P6, P7 to reach position P1, whereas the centripetal return stroke is carried out directly from position P1 to position P2 passing through intermediate positions such as P7 and P8, where loop withdrawal takes place. With the trajectory defined by positions P3, P4, P5 and P6, the extension 24B is prevented from becoming inserted into the terry or loop which has just been abandoned, even if the next forward movement of said extension 24B immediately follows its withdrawal movement. In this respect, the lifting of the end 24B in its forward trajectory means that said end passes over the abandoned loop, even if this is still almost in the position in which it was abandoned.

To produce this result, the sinker 24 is firstly cut away in the region of the contours 24X and 24Y. This defines a fulcrum point indicated by 30 in a position approximately corresponding with, that is, approximately opposite to the butt 24A but on the concave side of the sinker 24, so that the sinker can rotate in the direction of the arrow f1 of FIG. 2 when located in that space in the slide seat corresponding to the rear 24C, due to the fact that the sinker has been cut away in the contour region 24X indicated by the dashed and dotted line.

Figure 5A:
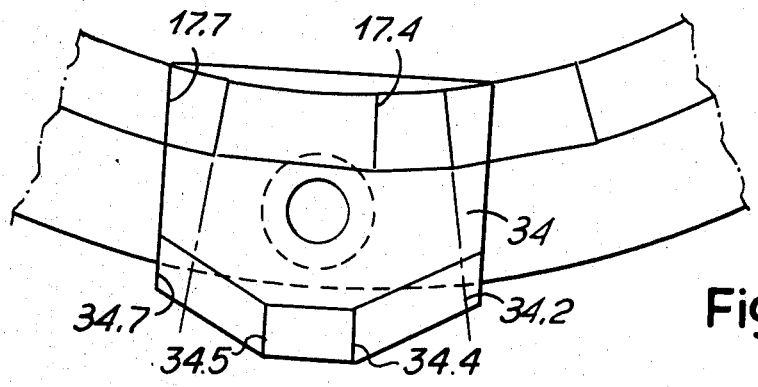
FIGS. 5A, 5B show various mutually coordinated contours for controlling the sinkers.
Figure 5B:
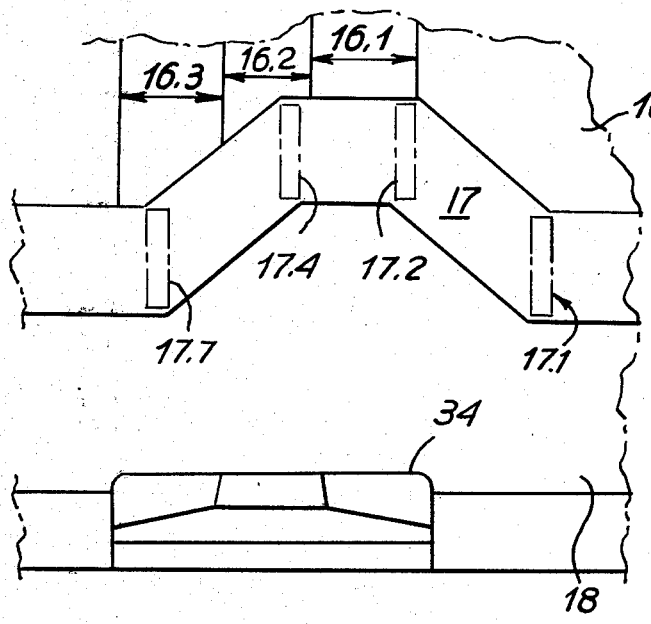
Figure 6:
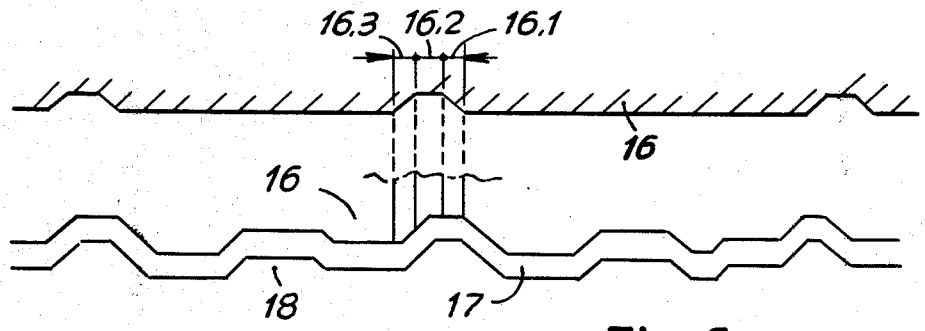
FIG. 6 shows a more extended development of the contours of FIG. 5B and of the control surface.

Secondly, a cam contour 34 is provided in each region over which the sinker 24 has to move forward, this cam contour being arranged to act on the edge 24E of the sinker 24 adjacent to the extension 24B. FIG. 5A shows a plan view of the cam contour 34, and FIG. 5B a front view, both these figures showing, coordinated with the cam track 34, the corresponding contour which acts on the butt 24A, the cam track being indicated by 17 and defined by the elements 16 and 18. The contour 34, over the portion 34.2–34.4, acts to cause the end of the extension 24B to pass through the trajectory P2, P3, P4, whereas the cam track 17 acts on the butt 24A approximately over the positions 17.2–17.4, representing the halt of the sinker in its rear position. During this stage there is, practically, only a rotation of the sinker about the fulcrum 30. This is allowed by the presence in the element 16 of a gradually rising recess 16.1 so that the sinker is guided by the contour 34 over the portion from point 34.2 to point 34.4 and by the contour 16.1 to carry out the trajectory from P2 to approximately P4. Immediately afterwards, the sinker 24 begins to move forward with angular sliding between position 17.4 and position 17.7, to reach position P7. Over this portion of the cam track 17, the cam 34 comprises a portion from 34.4 to 34.5 in which no rotation of the sinker about the point 30 is induced, whereas in the next portion from 34.5 to 34.6 there is a reverse rotation of the sinker to reach position P7 from position P5 by way of position P6, so that the sinker reaches point 34.7 of the contour 34. This reverse rotation of the sinker about point 30 to reach position P7 from position P5 is guided by a portion 16.3 of the recess in the element 16 besides being guided by the contour 34 over the portion from 34.5 to 34.7. The intermediate portion 16.2 of said recess in the element 16 corresponds to the passage of the ends of the extension 24B from position P4 to position P5.

Thus by means of the recess portions 16.1, 16.2, 16.3 in the element 16 and by means of the cam contour 34, the rotation of the sinker about the fulcrum point 30 is controlled positively in one direction and then in the other, while the sinker can be made to slide along its own seat, these movements thus being combined to give the required trajectory defined by positions P2, P3, P4, P5, P6, P7 and P1, and the direct reverse trajectory defined by positions P1, P7, P8, P2.

These obligatory paths mean that there is no possibility or risk of the extension 24B becoming again inserted into a loop or terry which has just been abandoned, even though the sinker is made to move forward again immediately after abandoning a loop (i.e. during the immediately subsequent yarn feed), in order to pick up the yarn for forming a further loop or terry. The result is that loops or terrys can be formed for each passage in front of a yarn feed, and therefore for each course, so producing an article with a terry or loop density which is much higher than that obtained with conventional machines.

The drawing shows only one embodiment given by way of practical example only, and modifications can be made both to the shapes and arrangements thereof without leaving the scope of the inventive idea.

What is claimed is:

1. An improved double cylinder circular knitting and stocking machine for forming articles of terry fabric of the type having upper and lower cylinders, a ring of arcuate terry sinkers in the upper cylinder, each sinker having a concave edge with a concave contour and a convex edge with a convex contour, the upper cylinder having arcuate seats defining a circular path in one end of the upper cylinder, each of the sinkers being slidably received in a respective one of the arcuate seats for reciprocating angular movement, each of the sinkers having a working end for forming a terry loop and a butt on the convex edge for controlling the reciprocating movement of the respective sinker, and a loop withdrawal ring mounted adjacent the one end of the upper cylinder for retaining the terry loop during the withdrawal of the working end therefrom in the centripetal direction, the improvement comprising, in combination therewith, each of the terry sinkers having a partially cut-away concave contour to allow rotation in the plane of the respective sinker during movement thereof in the circular path, and the upper cylinder including cam means for rotating the working end of each of the sinkers before the forward movement of the sinker so as to move the working end away from the withdrawal ring, to pass the working end over the terry loop formed on the previous course, and then to rotate the working end in the reverse direction for forming the next terry loop, and said cam means including cams for imposing both said rotation and the subsequent reverse rotation of the sinker during the completion of the forward movement of the sinker by angular sliding.

2. A machine as claimed in claim 1, wherein the partially cut-away concave contour is cut away between the working end and an intermediate point which defines a fulcrum lying approximately in a position opposite the control butt, and said skirt recess is shaped so that it acts on the convex contour of that part of the sinker most distant from the working end.

3. A machine as claimed in claim 1, wherein the cam means has a member arranged to act along the convex contour of the sinker adjacent to the working end and the loop withdrawal ring.

* * * * *